United States Patent [19]

Ellsworth et al.

[11] Patent Number: 4,912,865

[45] Date of Patent: Apr. 3, 1990

[54] MULTI-AXIS PIVOTING DISPLAY SIGN

[75] Inventors: Steven J. Ellsworth, Walnut; Richard N. Philippi, Garden Grove; James E. Ahrens, Hacienda Heights, all of Calif.

[73] Assignee: Couch & Philippi, Inc., Stanton, Calif.

[21] Appl. No.: 260,306

[22] Filed: Oct. 19, 1988

[51] Int. Cl.[4] ..... G09F 7/00

[52] U.S. Cl. ..... 40/602

[58] Field of Search ..... 40/602, 613, 479; 16/358, 282, 283

[56] References Cited

U.S. PATENT DOCUMENTS

| | | | |
|---|---|---|---|
| 61,766 | 2/1867 | Schafer | 16/358 |
| 664,049 | 12/1900 | Johnson | 40/613 |
| 691,551 | 1/1902 | Kincaid | 16/282 |
| 1,361,911 | 12/1920 | Schwesinger, Jr. | 40/613 |
| 1,824,444 | 9/1931 | Mueller, Jr. et al. | 40/602 |
| 1,856,349 | 5/1932 | Bigelow | 40/613 |
| 2,054,230 | 9/1936 | Patterson | 40/613 |
| 2,467,187 | 4/1949 | Capper | 40/613 |
| 2,533,778 | 12/1950 | Eckhardt | 40/609 |
| 2,841,902 | 7/1958 | Pfundt | 40/602 |
| 2,867,839 | 1/1959 | Squire | 16/358 |
| 3,001,225 | 9/1961 | Squire | 16/287 |
| 3,088,235 | 5/1963 | Kies | 40/477 |
| 3,287,840 | 11/1966 | Keats | 40/613 |
| 4,214,393 | 7/1980 | Long | 40/613 |
| 4,365,435 | 12/1982 | Snyder, Jr. | 40/602 |

*Primary Examiner*—Cary E. Stone

*Attorney, Agent, or Firm*—Christie, Parker & Hale

[57] ABSTRACT

A display sign embodying the present invention has a normally vertical display panel having first and second sides and at least one face, between the sides, for information. A base supports the panel. First and second side supports are mounted on the base and are positioned adjacent to the first and second sides, respectively. First and second horizontally spaced apart pivots support the display panel on the first side support and first and second horizontally spaced apart pivots support the display panel on the second side support. The display panel rotates about a first axis of rotation through the first pivots as the display panel is forced to move in a first direction and the display panel rotates about a second axis of rotation through the second pivots, as the display panel is forced to move in a second direction from the vertical.

12 Claims, 6 Drawing Sheets

14
14a
26'
12a'
40
10'
6
6

14
26'
12a'
10'
40
28'
12b'
39

14
B
C.G
A

MULTI-AXIS PIVOTING DISPLAY SIGN

BACKGROUND OF THE INVENTION

1. Field

The present invention relates generally to the field of display signs and more particularly to pivoting display signs 2. Prior Art Portable outdoor display signs have long been popular. They have found use for advertising, sales, and providing information regarding prices and wares. As a convenience to their utilization, signs are preferably of a size and weight to permit their easy setup and removal.

Because they are portable and subject to the weather, there has been a continuing problem with lack of stability and damage to signs caused by wind. When constructed of light materials, they overturn easily. Signs of heavier construction are more stable, however, their heavier weight make them more difficult to set-up and remove. With strong winds increased weight of the sign may not avoid turning over.

One display sign has a display panel that is free to pivot about an axis in response to wind forces. While this permits somewhat lighter construction, such signs require significant counterweights. The portion of the display panel below the axis of rotation is dimensioned and made considerably heavier than the portion above, to enable the sign panel to return to a full upright position after being deflected by the wind. Total weight of the display panel below the pivot of 2 to 3 time the weight above the pivot have been used to insure the sign returns to an upright position.

A disadvantage of the above-mentioned pivoting display panel sign is its large weight and the delay or even inability of having the display panel return to a vertical position when in a wind.

SUMMARY OF THE INVENTION

A display sign embodying the present invention has a normally vertical display panel having first and second sides and at least one face, between the sides, for information. A base supports the panel. First and second side supports are mounted on the base and are positioned adjacent to the first and second sides, respectively. First and second horizontally spaced apart pivots support the display panel on the first side support and first and second horizontally spaced apart pivots support the display panel on the second side support. The display panel rotates about a first axis of rotation through the first pivots as the display panel is forced to move in a first direction and the display panel rotates about a second axis of rotation through the second pivots, as the display panel is forced to move in a second direction from the vertical.

Such an embodiment of the present invention overcomes disadvantages of the prior art. By way of example, the display panel will be pivoted from vertical under force of wind but is more reliably returned back to a vertical position. Also, it is possible to reduce the weight of the sign by reducing the weight of the sign panel required to return the display panel to the vertical position.

DETAILED DESCRIPTION OF THE PREFERRED EMBODIMENT

Figure 1:
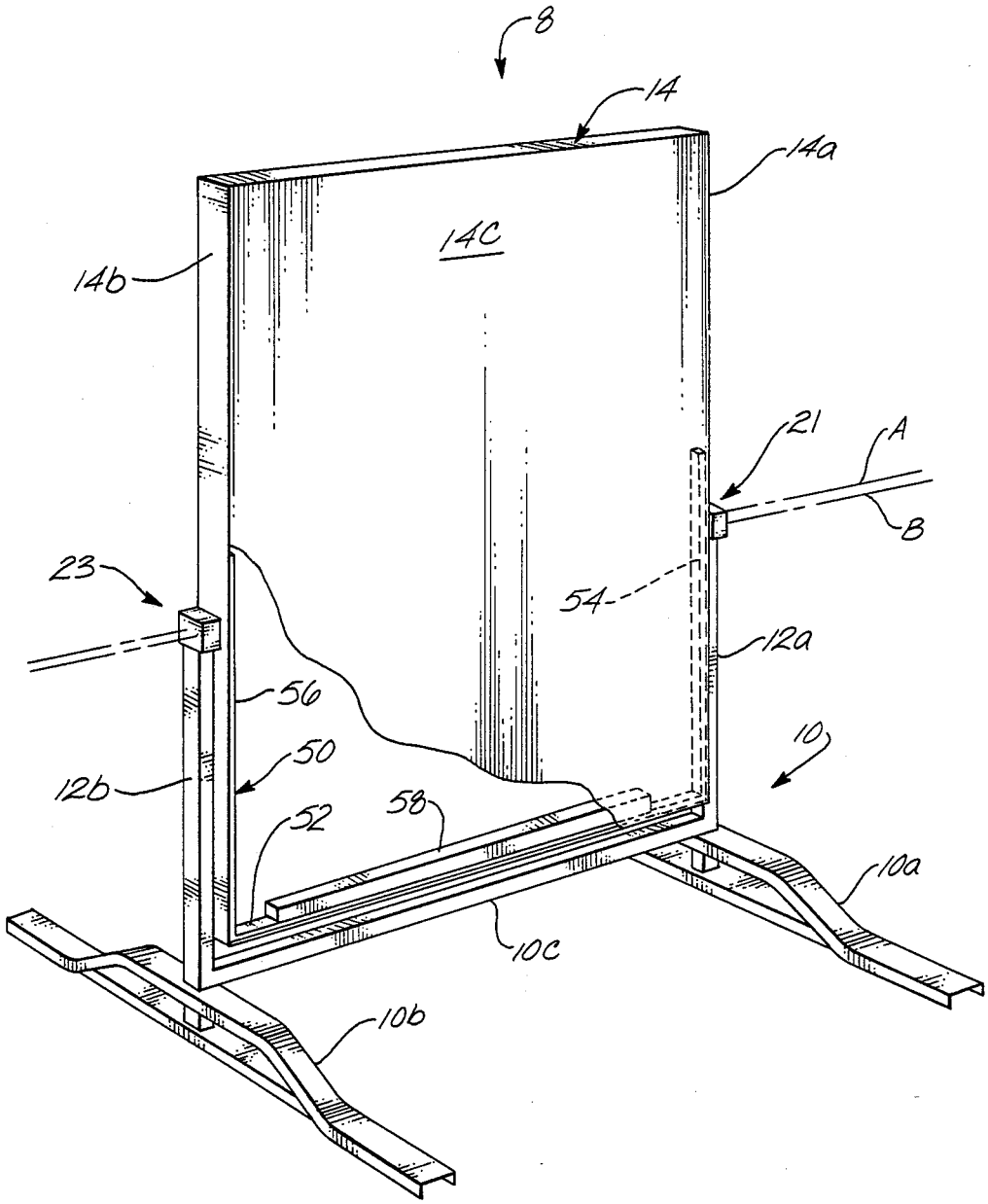
FIG. 1 is a schematic and perspective view of a multipivot display sign and base and embodies the present invention. A portion of the skin of the display panel is broken away to reveal the stiffener and weight on the inside of the display panel.
Figure 2:
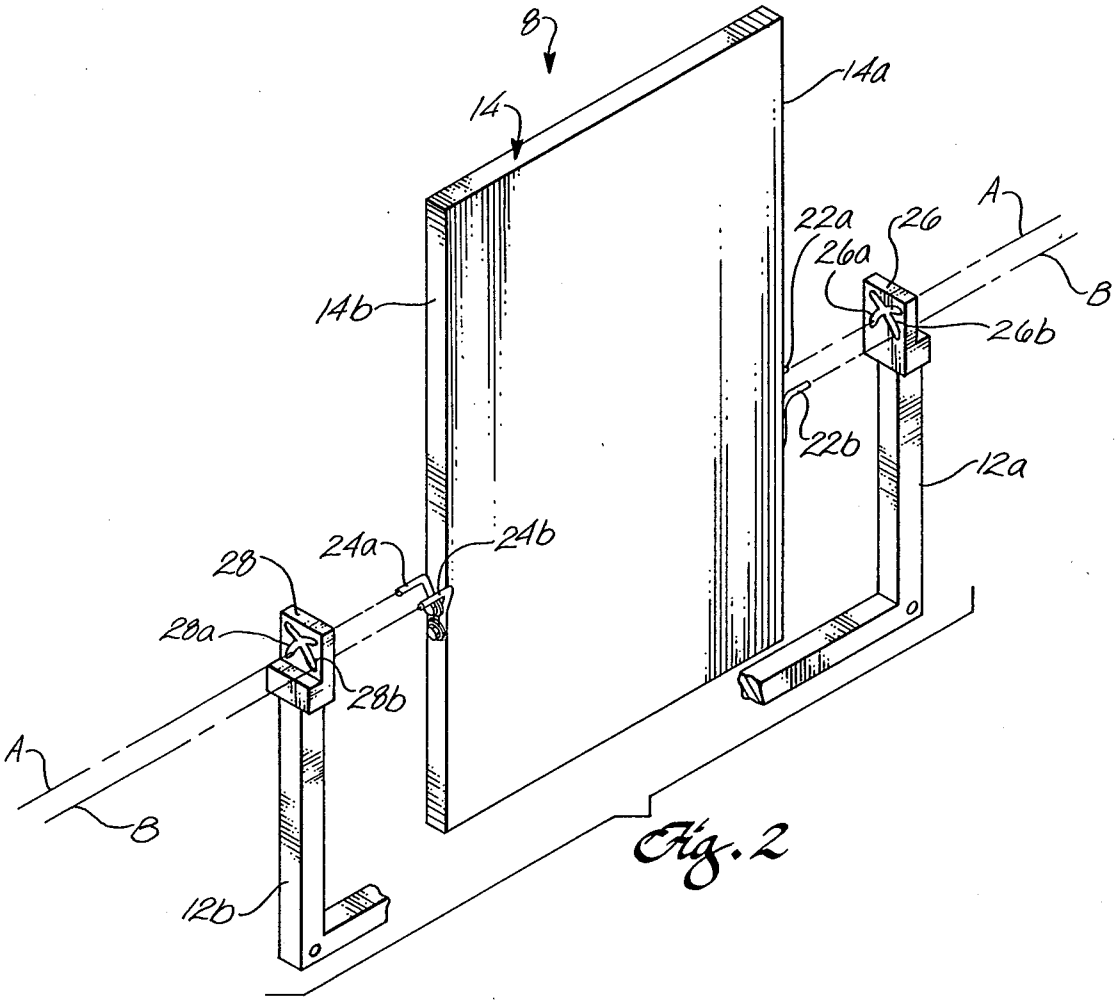
FIG. 2 is a perspective view of a specific embodiment of the display sign of FIG. 1 with a portion of the base support broken away and with portions exploded apart to illustrate the present invention.

Consider now the embodiment of the invention depicted in FIGS. 1-2. The display sign 8 includes a base 10, a normally vertical display panel 14, first and second side supports **12*a* and 12*b*, mounted on the base 10, and extending along, respectively, sides 14*a* and 14*b* of display panel 14. First and second horizontally spaced apart pivots, 21, 23 including a pivot pin 22*b* and a groove 26*a* and pivot pin 22*a* and groove 26*b*, support the display panel on side support 12*a*. First and second horizontally spaced apart pivots, including pivot pin 24*a* and groove 28*a* and pivot pin groove 28*b* support the display panel on side support 12*b*. The first pivots, including pivot pin 22*a* and groove 26*a* and pivot pin 24*a* and groove 28*a* jointly guide the display panel for rotation about a first axis A of rotation as the display sign panel is forced to move in a first (i.e., counter clockwise direction) as seen in FIG. 2. Similarly, second pivots, including pivot pin 22*b* and groove 26*b* and pivot pin 24*b* and groove 28*b* jointly guide the display panel for rotation about a second axis B as the display panel is forced to move in a second direction (i.e., clockwise) as seen in FIG. 2** from the vertical position.

Figures 3, 4, 5:
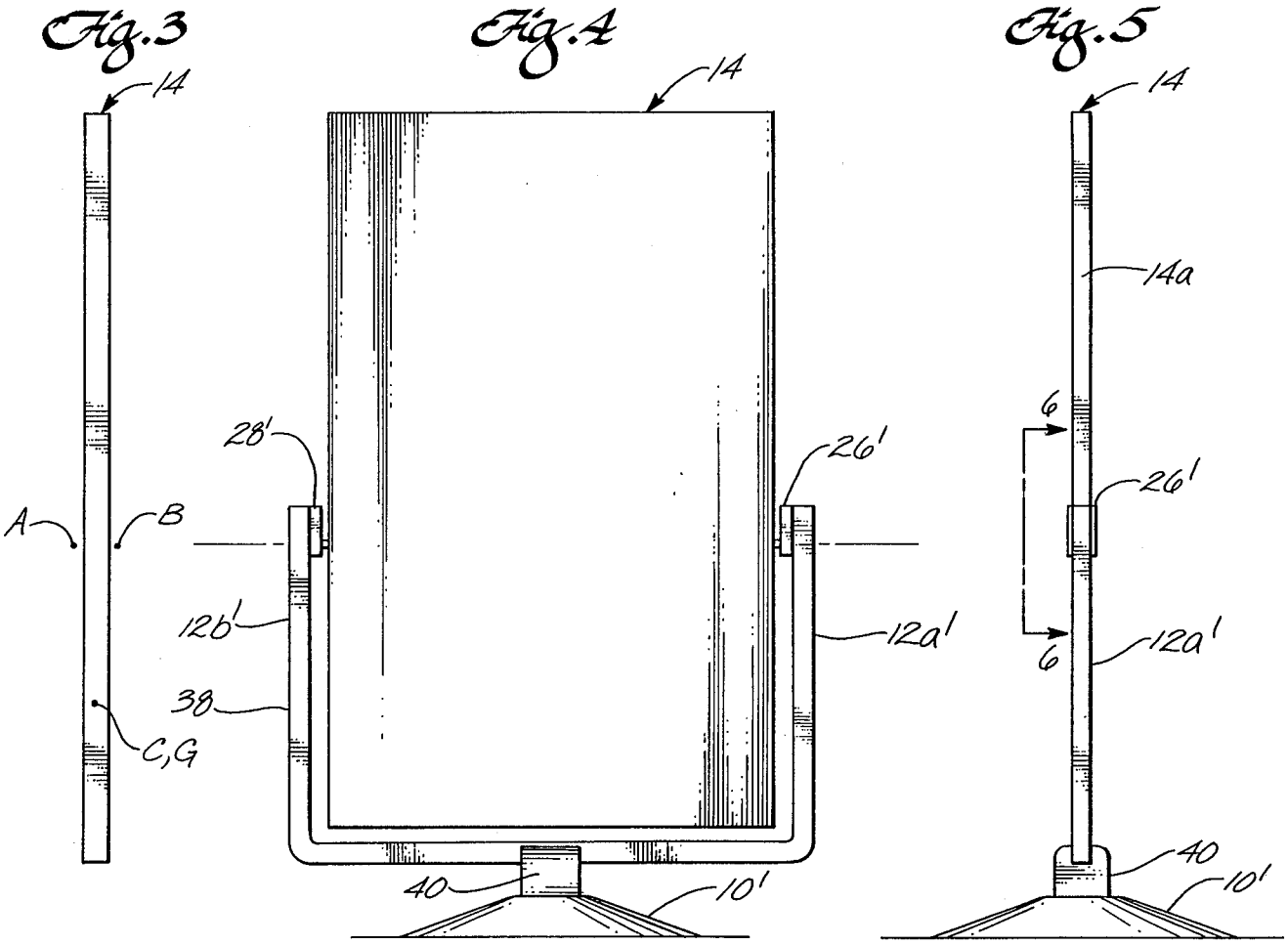
FIG. 3 is a schematic and side elevation view of the display panel illustrating the position of the two axis of rotation in relation to the center of gravity CG of the lower portion of the display panel below the axis of rotation.
FIG. 4 depicts a front elevation view of an alternate display sign and embodies the present invention.
FIG. 5 is a side elevation view of the display sign of FIG. 4.

This arrangement is significant in that the center of gravity of the display panel indicated at CG in FIG. 3 is located at about the mid point between the two axis A and B and, therefore, tends to stabilize or return the display panel to a vertical position. However, whenever the display sign panel tends to rotate about one of the axis, the center of gravity, instead of being aligned vertically below the axis, is offset from the axis and on the up side which creates an increased lever arm between the axis of rotation and the center of gravity, tending to rotate the sign back to the vertical position.

Pivot pins 22*a* and 22*b* are arranged in a pair adjacent side 14*a* of the display panel, and extend into at least one receptacle formed by arcuate shaped grooves 26*a* and 26*b* of pivot head 26. Similarly, pivot pins 24*a* and 24*b* are arranged in a pair adjacent side 14*b* of the display panel, and extend into at least one receptacle formed by arcuate shaped grooves 28*a* and 28*b* of pivot head 28. The pivot heads 26 and 28 have cups (not shown) which mount over and on the end of, preferably tubular shaped side supports 12*a* and 12*b*, respectively.

When the display panel rotates counter clockwise as seen in FIG. 2, the pivot pins 22*a* and 24*a* are engaged and are guided at the bottom of grooves 26*a* and 28*a*, as seen in FIG. 2 so that the pins rotate relative to the receptacles or grooves. At this same time, the pivot pins 22*b* and 24*b* are guided in a arcuate shaped path within the grooves 26*b* and 28*b*, respectively. Similarly, when the display panel rotates clockwise, as seen in FIG. 2, the pivot pins 22*b* and 24*b* are engaged and are guided for rotation at the bottom end of grooves 26*b* and 28*b*, whereas the pivot pins 22*a* and 24*a* are guided in an arcuate shaped path within the receptacles or grooves 26*a* and 28*a*, respectively.

Figure 7:
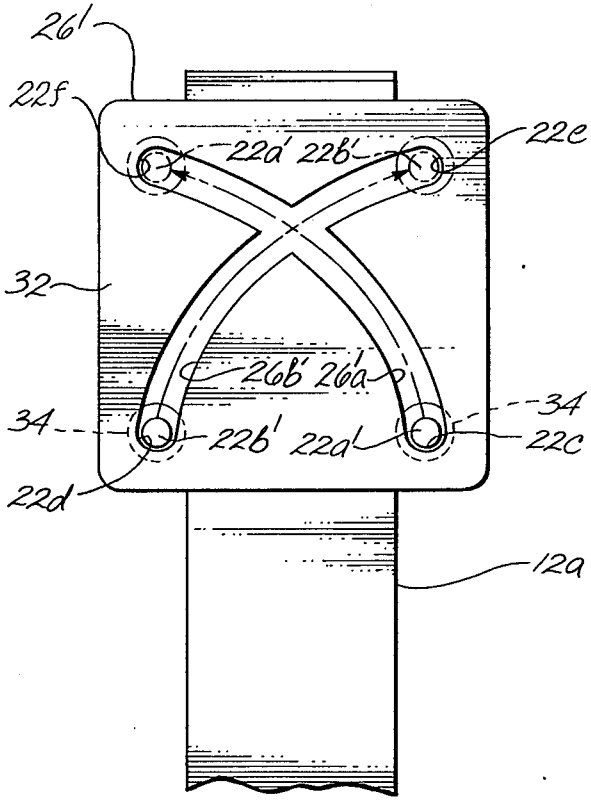
FIG. 7 is a section view taken along the liens 7—7 of FIG. 6.

The rounded bottom of each of the grooves, such as that shown at 22*c* and 22*d* of FIG. 7, form a receptacle for retaining the corresponding pivot pin fixed in a transverse direction during rotation, but yet allowing the other pivot pin of the pair to be guided in an arc within and relative to its corresponding groove. In this manner a pivot pin and the corresponding groove of the pivot head each form a pivot part of each of the two pivots at each side of the display panel.

As best seen in FIG. 2, the pivot pins 22*a* and 24*a* extend in opposite directions from the display panel along the axis A, whereas the pivot pins 22*b* and 24*b* extend in opposite directions from the display panel along the axis B.

A stop is provided for preventing the display panel from rotating more than 90 degrees in either direction from vertical. In this regard, each of the grooves includes an upper end, such as 22*e* and 22*f* shown in FIG. 7, which engages and stops the movement of the corresponding pin which is moving along the groove when the sign panel reaches a 90 degree angle. The embodiment of FIGS. 1–2 employ pivot pin pairs which are each formed of a single unitary rod bent to the shape depicted in FIG. 2 and fastened to the corresponding side 14*a* and 14*b* of the display panel. The pivot pins extend beyond the opposite faces of the display panel to increase the horizontal distance between the pivot panel and the center of gravity of the display panel.

FIGS. 4–8 depict an alternate embodiment of the invention. In this embodiment, the pivot heads 26 and 28 are replaced by pivot heads 26' and 28' which are bolted or rivetted to a side of the corresponding side support which faces the adjacent side of the display panel. By way of example, pivot head 26' is affixed to side support 12*a'* by rivets as indicated at 30 in FIG. 6.

Figure 6:
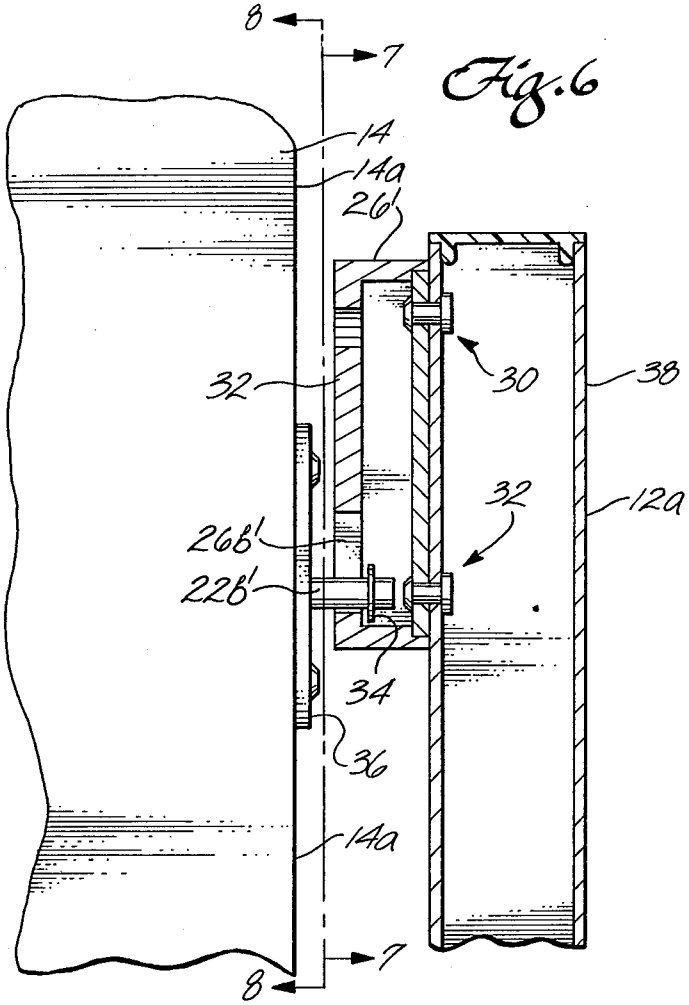
FIG. 6 is a view taken along the lines 6—6 of FIG. 5 with a portion of the bracket and side support in cross section.
Figure 8:
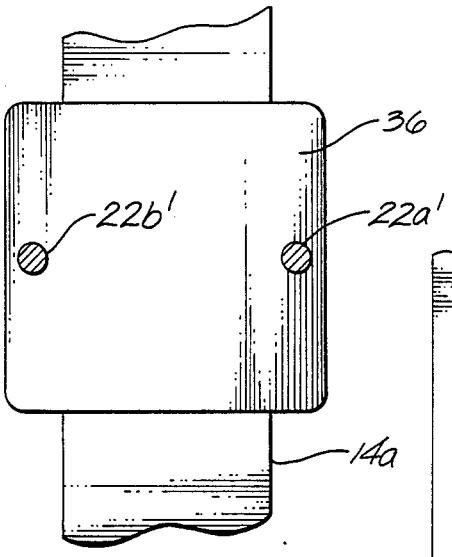
FIG. 8 is a section view taken along the lines 8—8 of FIG. 6.

In this embodiment, the pivot pins are mounted on and extend, parallel to each other, from a plate through the corresponding groove to a back side of a front plate 32 of bracket 38, where a disc shaped retainer 34 is affixed to and retains the pins within the corresponding grooves during movement. Referring to FIGS. 6 and 7, pivot pins 22'*a* and 22'*b* are, by way of example, rigidly mounted on a rectangular plate 36 which, in turn, is connected by rivets (not shown) to side 14*a* of panel 14. Pins 22*a'* and 22*b'* and grooves 26*a'* and 26*b'* extend clear through to the backside of front plate 32 where retainers 3 are affixed to the pins.

The embodiment of FIGS. 1–2, has a base that includes two spaced apart elongated and parallel legs 10*a* and 10*b* on which the side supports 12*a* and 12*b* are mounted. Cross brace 10*c* is affixed to and connects together the two side supports 12*a* and 12*b* and the legs 10*a* and 10*b*. The legs extending out a sufficient distance from each of opposite faces of the display panel so that the center of gravity of the lower portion of the display panel is always within the rectangular outer perimeter defined by a rectangle passing through the ends of the legs in contact with the floor or ground.

By way of contrast, the embodiment of FIGS. 4–8 as a circular inverted cymbal shaped bas 10' connected through a riser 40 to "U" shaped support 38 having side supports 12*a'* and 12*b'*. The pivot heads 26' and 28' are attached, as described above, to the upper ends of the "U" shaped side support 38. Again the outer perimeter of base 10', in contact with the floor or ground, is dimensioned so that the center of gravity of the lower part of the display panel below the pivots is always within the outer perimeter.

Figure 9:
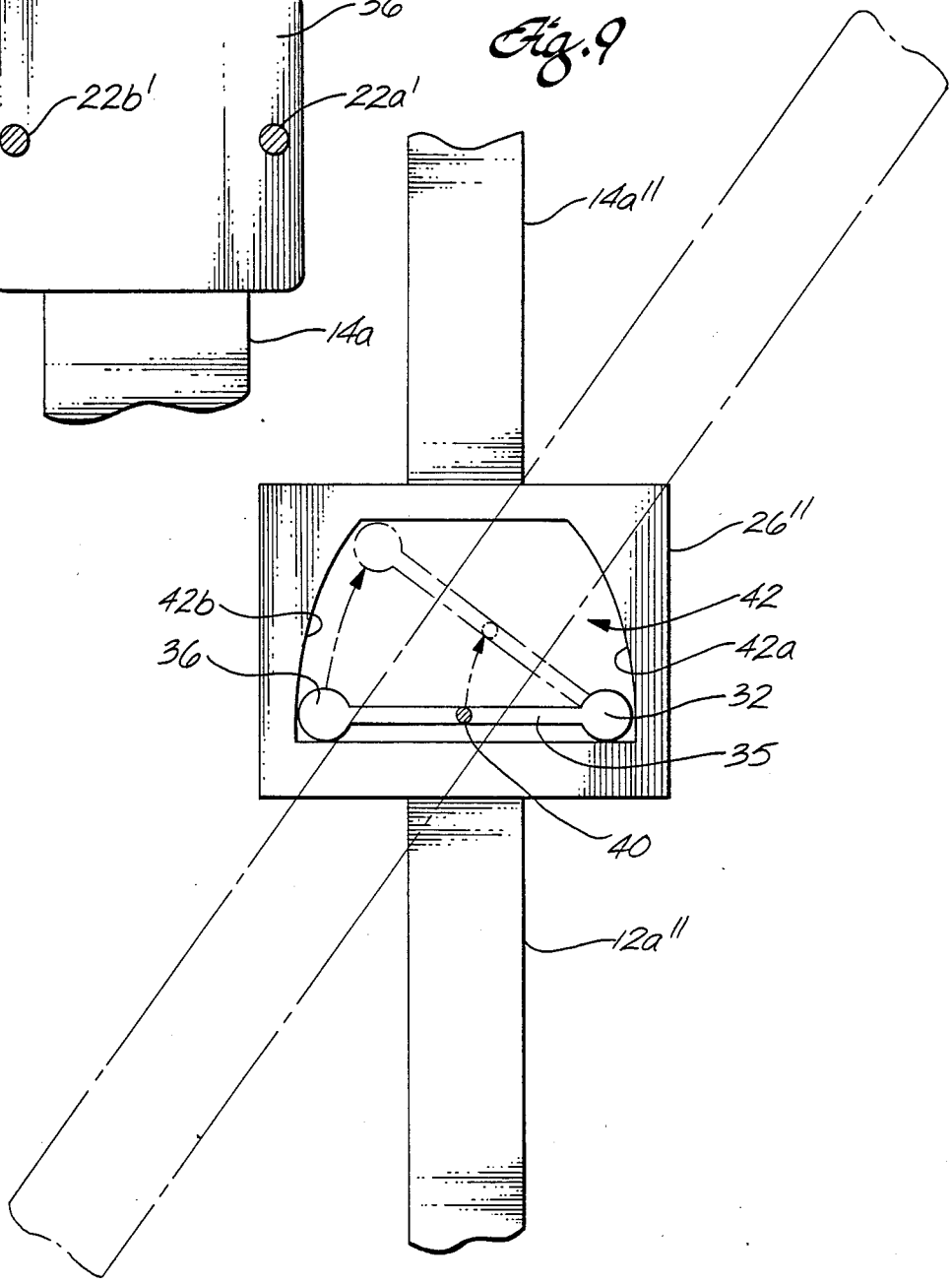
FIG. 9 is a section view similar to FIG. 7 of a still further embodiment of the invention The display sign is depicted after rotation in a diagonal position in broken lines.

FIG. 9 depicts an alternate embodiment of the invention in which the pivot pins are in the form of spherical shaped pivot members or balls 32 and 36, connected together by a rod 35. A horizontally extending shaft 40 connected at right angles to and at the center of rod 35 is connected to the corresponding 14*a''* side of the display panel as illustrated in solid and phantom lines. The pivot pins 32 and 36 and rod 35 extend into a groove or receptacle 42 formed in the face of pivot head 26'' which faces the side 14*a''* of the display panel. The upper outer perimeter of the receptacle is arcuate shaped as depicted at 42*a* and 42*b* allowing the adjacent pin to move in an arcuate shaped pattern relative to the groove as the display panel pivots about the other pivot pin.

The display panels are preferably formed with two apparently facing rectangular faces between the sides 14*a* and 14*b*. The skin of the panel is formed from one or more sheets of material formed and connected together leaving a hollow interior. Referring to FIG. 1, within the hollow interior there is a "U" shaped stiffener 50 that has a bottom portion 52 along the bottom side of the display panel and two upward extending parallel legs 54 and 56 extending along the inside of sides 12*a* and 12*b*, respectively. A weight 58 is affixed to a bottom portion of the display panel. However, the weight is not necessary if the weight of the display panel and stiffener below the pivots is sufficiently large.

Preferred performance has been obtained where the pivot pins are located at the upper extremity of the lower 2/5 of the display panel and where the weight of the display panel (including the skin and members 50 and 58) below the pivots is about 1½ times the weight of the display panel above the pivots. This allows weight of the sign display to be minimized.

The display panel may also be constructed of a single thin sheet of metal or plastic with a tube frame connected around the edge for rigidity. The pivot pins would then be attached to the frame. A weight can be slid into the lower end of the tube or frame.

Figure 10:
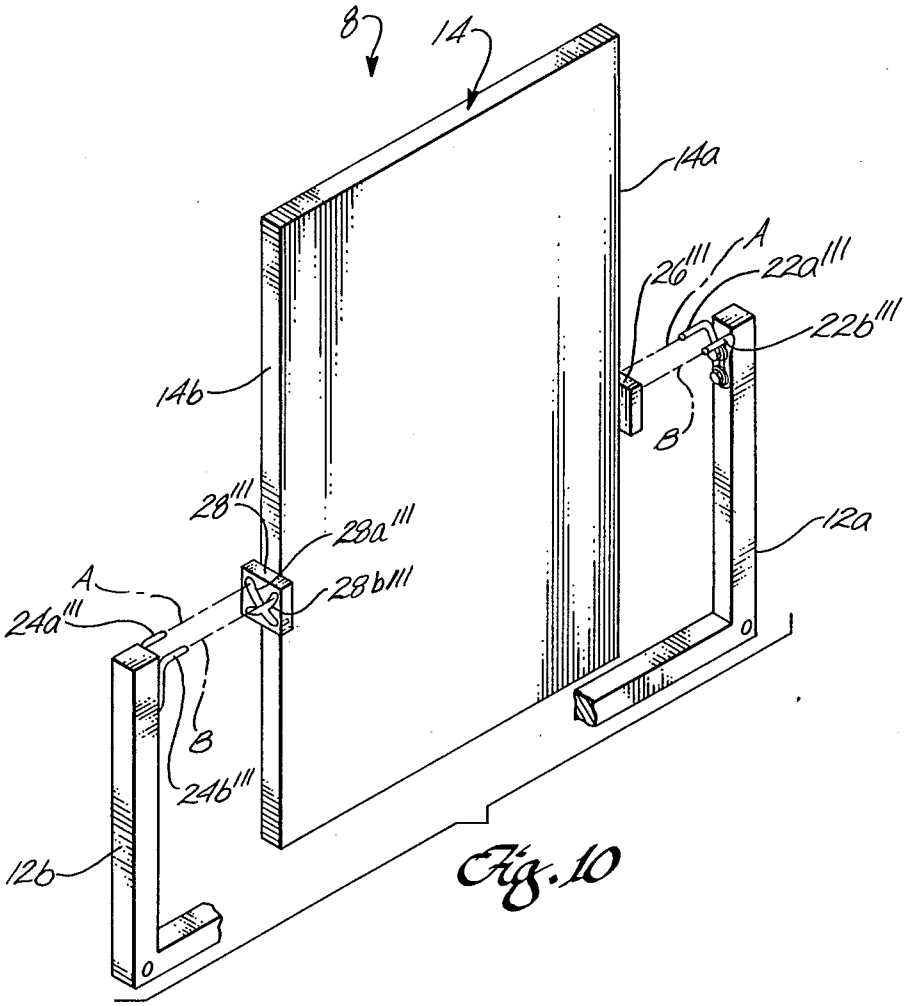
FIG. 10 is a perspective view similar to FIG. 2 with the pivot head and pivot pins reversed and embodying the present invention.

FIG. 10 depicts an alternate embodiment of the invention in which the pivot pins and 22*a'''* and 22*b'''* (corresponding to 22*a* and 22*b*) are attached to the side support 12*a* and the pivot pins 24*a'''* and 24*b'''* (corresponding to 24*a* and 24*b*) are attached to side support 12*b*. The pivot heads 26''' and 28''' (corresponding to 26 and 28) are attached to side supports 14*a* and 14*b*, respectively, of the display panel 14. Since the display panel and pivot heads will hang on the pivot pins, the pivot heads are rotated 180 degrees and, therefore, upside down from the position shown in FIGS. 2 and 7. In this way, when the sign is vertical, the pivot pins are in the ends 22*c* and 22*d* of the pivot head seen in FIG. 7 and rotates down towards ends 22*e* or *f* as the display panel rotates.

Accordingly, the foregoing description should not be read as pertaining only to the precise structures and techniques described, but rather should be read consistent with, and as support for, the following claims, which are to have their fullest fair scope.

What is claimed is:

1. A display sign comprising:

(a) a normally vertical display panel having first and second sides and at least one exposed face, between the sides, for information;

(b) a base for supporting the display panel;

(c) first and second side supports mounted on said base and positioned adjacent corresponding said first and second sides, respectively; and (d) first and second horizontally spaced apart pivots for supporting the display panel from the first side support and first and second horizontally spaced apart pivots for supporting the display panel from the second side support, the display panel rotating about a first axis of rotation through the first pivots as the sign panel is forced to move in a first direction and the display panel rotating about a second axis of rotation through the second pivots, as the display panel is forced to move in a second direction.

2. The display sign of claim 1 wherein each pivot comprises a first pivot part on the display panel and a second pivot part on the corresponding side support, one of the first and second pivot parts of each pivot supporting the other during rotation of the display panel.

3. The display sign of claim 1 wherein the first and second pivots for supporting the display panel from the first side support comprise a pair of spaced apart pivot pins and a corresponding at least one receptacle for receipt of such first and second pivot pins, and wherein the first and second pivots for supporting the display panel from the second side support comprises a pair of spaced apart pivot pins and a corresponding at least one receptacle for receipt of such further pivot pins.

4. The display sign of claim 3 wherein either one of the pivot pins in each pair and the corresponding at least one receptacle rotate relative to each other while the other of the pivot pins in each pair and the corresponding at least one receptacle move relative to each other, with such other pivot pin or each pair guided in the corresponded at least one receptacle.

5. The display sign of claim 4 wherein each at least one receptacle comprises a first arcuate shaped guide groove for receiving a first pivot pin and a second arcuate shaped guide groove for receiving a second pivot pin of the corresponding pair.

6. The display sign of claim 5 wherein each groove comprises an end portion for engaging the corresponding pivot pin during rotation of the display panel about such pivot pin while the other pivot pin of the corresponding pair moves along the arcuate shaped guide groove in which it extends.

7. The display sign of claim 6 wherein the pairs of pivot pins are carried on the display panel and the at least one receptacles are carried, one on each of the side supports.

8. The display sign of claim 6 wherein the pairs of pivot pins are carried, one pair on each of the side supports, and the at least one receptacles are carried on the display panel.

9. The display sign of claim 6 wherein each pivot pin of each pair extends, from a support for such pin towards the corresponding receptacle, in an opposite direction form the direction of each of the pins in the other pair of pivot pins.

10. The display sign of claim 9 comprising a separate pivot head in which each said at least one receptacle is located.

11. A display sign comprising:

(a) a display panel;

(b) a support for supporting the display panel in a normally vertical position, the support comprising first and second horizontally spaced apart pivots, the display panel rotating away from vertical about a first axis of rotation through the first pivot as the panel is forced to move in a first direction and the panel rotating away from vertical about a second axis of rotation through the second pivot as the panel is forced to move in a second direction, the sign panel having a portion below the pivots for urging the display panel to a vertical position due to the pull of gravity.

12. The display sign of claim 11 wherein the display panel has a center of gravity and the first axis and the second axis of rotation are on opposite sides of the center of gravity of the display panel when in the normal vertical position.

* * * * *

UNITED STATES PATENT AND TRADEMARK OFFICE

CERTIFICATE OF CORRECTION

PATENT NO. : 4,912,865

DATED : April 3, 1990

INVENTOR(S) : S.J. Ellsworth; R.N. Philippi; J.E. Ahrens

It is certified that error appears in the above-identified patent and that said Letters Patent is hereby corrected as shown below:

Column 1, line 8, after "signs" insert a period.
Column 1, line 32, change "time" to -- times --.

Column 2, lines 9,11,60,64,65,67, change "axis" to -- axes -- (all occurrences).
Column 2, line 21, change "liens" to -- lines --.
Column 2, line 26, after "invention" insert a period.
Column 2, line 42, change "26a" to -- 26b --, and change "26b" to -- 26a -- respectively.

Column 3, line 16, change "a" to -- an --.
Column 3, line 48, change "side" to -- sides --.
Column 3, line 65, change "22'a" to -- 22a' --.
Column 3, line 65, change "22'b" to -- 22b' --.

Column 4, line 2, change "3" to -- 34 --.
Column 4, line 15, change "bas" to -- base --.

Column 6, line 28, change "form" to -- from --.

Signed and Sealed this

First Day of October, 1991

*Attest:*

HARRY F. MANBECK, JR.

*Attesting Officer*

*Commissioner of Patents and Trademarks*